US005538396A

United States Patent [19]

Meierhoefer

[11] Patent Number: 5,538,396

[45] Date of Patent: Jul. 23, 1996

[54] WATER PUMPING SYSTEM

[76] Inventor: Ned S. Meierhoefer, 1763 Walker Valley Rd., Cleveland, Tenn. 37312

[21] Appl. No.: 327,976

[22] Filed: Oct. 24, 1994

[51] Int. Cl.[6] ..... F04B 49/00

[52] U.S. Cl. ..... 417/19; 417/44.2

[58] Field of Search ..... 417/18–19, 36, 417/38, 44.2, 225–227, 423.15, 423.3; 415/213.1

[56] References Cited

U.S. PATENT DOCUMENTS

| | | | |
|---|---|---|---|
| 732,704 | 7/1903 | Bryan . | |
| 1,285,629 | 11/1918 | Crowe . | |
| 1,428,238 | 9/1922 | Keating . | |
| 1,641,878 | 9/1927 | Boland . | |
| 1,894,393 | 1/1933 | Bigelow . | |
| 1,964,032 | 6/1934 | Cook et al. | 103/113 |
| 2,275,066 | 3/1942 | Otterbourg | 103/25 |
| 2,312,526 | 3/1943 | Curtis | 103/87 |
| 2,369,440 | 2/1945 | Curtis | 103/87 |
| 2,440,981 | 5/1948 | Smith | 417/44.2 |
| 2,651,995 | 9/1953 | Blackburn | 417/44.2 |
| 2,945,447 | 7/1960 | Yamaguchi et al. | 103/77 |
| 2,986,308 | 5/1961 | Pacey et al. | 415/213.1 |
| 3,070,021 | 12/1962 | Tutthill | 103/25 |
| 3,370,544 | 2/1968 | Thorpe, Sr. | 417/44.2 |
| 3,481,274 | 12/1969 | Napolitano . | |
| 3,746,473 | 7/1973 | DeLancey et al. | 417/38 |
| 3,782,858 | 1/1974 | Deters | 417/26 |
| 3,819,297 | 6/1974 | East | 417/38 |
| 3,970,413 | 7/1976 | Duveau | 417/12 |
| 3,985,467 | 10/1976 | Lefferson | 417/44.2 |
| 3,999,890 | 12/1976 | Niedermeyer | 417/17 |
| 4,082,482 | 4/1978 | Erickson et al. | 417/408 |
| 4,087,204 | 5/1978 | Niedermeyer | 417/2 |
| 4,645,426 | 2/1987 | Hartley et al. | 417/38 |
| 4,844,700 | 7/1989 | Henderson | 417/225 |
| 5,009,579 | 4/1991 | Grant | 417/12 |
| 5,334,000 | 8/1994 | Nordlin | 417/423.15 |

FOREIGN PATENT DOCUMENTS

| | | | |
|---|---|---|---|
| 466084 | 6/1950 | Canada | 417/36 |

*Primary Examiner*—John J. Vrablik
*Assistant Examiner*—Xuan M. Thai
*Attorney, Agent, or Firm*—Luedeka, Neely & Graham

[57] ABSTRACT

A hydraulic pressure booster device suited for increasing in-line fluid pressures comprises the assembly of a vertically oriented, tubular, closed end, housing for a submersible fluid pump. The pump is secured to a cap flange which closes the top of the tubular housing, while the bottom of the tubular housing is closed with either an anchor plate or blind end cap. Compression seal fittings are used to seal the penetration of pump motor pump lead wires through the cap flange. Inlet flow received into the tubular housing is drawn through the submersible pump with a resultant increase in hydraulic pressure at the output. A housing pressure sensing switch interrupts pump operation to prevent pump damage during periods of low fluid level in the housing. Additional pump protection is provided via a pump outlet pressure monitoring switch which regulates the pump delivery pressure. Dimensional design features of the device enhance useability and maintainability.

30 Claims, 4 Drawing Sheets

WATER PUMPING SYSTEM

TECHNICAL FIELD

The present invention is directed to a hydraulic pressure booster device particularly suited for increasing the in-line water pressure from municipal water supplies. Use of the present invention for purposes of increasing water pressure is illustrative, not exclusive. It is contemplated that the present invention can also be used to increase in-line pressures of many fluid types.

DESCRIPTION OF THE PRIOR ART

Hydraulic pumps of the centrifugal type for raising water pressure from a supply level to a higher discharge level are unsuitable for boosting in-line pressure from a municipal supply at a street level extraction tap. While municipal water for residential and commercial use is generally supplied at a sufficient pressure level, there are circumstances where additional water pressure is needed by the user. For example, a user needing to pipe the water up a gradient from the municipal supply line could experience a significant loss in water pressure at the top of the gradient. Also, water pressure at the point of delivery from the municipal supply line may simply be too low for a host of reasons. Additionally, municipal sanitation and contamination regulations restrict or prohibit an individual user from entering the water line upstream of a flow meter. Hence, there is a need for a pump that is capable of operating within an isolation chamber that is supplied by a public water delivery system.

Installation and maintenance demands for such a water pressure booster device require a design that is relatively small, compact, and preferably one that can be installed vertically in a standard meter box downstream of the meter. There is a need for an orderly installation environment whereby the booster device can be positioned in construction stages.

Maintenance considerations require that the pump be easily installed and removed from the pump chamber. Water flow (both supply and output) to this pump chamber must be terminated during maintenance. Traditional water system facilities can typically be used to shut off supply flow, but there is a need for a means of shutting off back flow from the output line of the pump chamber to facilitate maintenance.

Submersible turbine or cyclone type pumps require no priming and generally have an extended lifetime, so long as they receive adequate motor cooling in the form of water flow. For such a pump to operate in a closed pump chamber, water flow must be monitored at both the output and input of the pump chamber to ensure adequacy for cooling purposes.

Finally, while size is an important consideration for installation, strength is at least equally important. Generally, strength and size are correlative.

It is, therefore, an object of the present invention to teach the construction of a hydraulic pressure booster device that is small and easy to install, yet structurally sufficient. Another object of the present invention is to augment existing water distribution systems for purposes of increasing water pressure from a municipal source. Another object of the present invention is to provide a means for blocking backflow from the booster pump chamber into a municipal distribution main.

Another object of the present invention is to provide a hydraulic pressure booster device that is highly maintainable. A still further object of the present invention is to monitor hydraulic flow and pressure to ensure adequacy for pump motor cooling purposes.

SUMMARY OF THE INVENTION

Regarding the foregoing and other objects of the invention to be subsequently described or made apparent, the present invention includes a tubular pump chamber for housing a submersible turbine water pump. This chamber is usually constructed of steel or high density polymer material having a closed bottom of either an anchor plate or blind end cap and a ring flange permanently affixed at the top, again of either steel or high density polymer material. Because of its narrow, vertical dimensions, the present invention can be installed in the ground inside a standard water meter box.

A top cap flange, preferably of steel material, is constructed to mount to the permanent top ring flange via flange bolts and a flange gasket with the cap flange having a male threaded pipe nipple located in the center and sized to accept the female threaded coupling of the pump discharge. Also included on the cap flange are a plurality of couplings fitted with compression type fluid seals through which electrical lead wires serving the pump motor are routed. Additionally, a low inlet pressure cutoff switch is affixed to the cap flange.

Since the water service for the present invention pumping system is usually one of presumed sanitation, the integrity of that presumption is protected by a flow rectification device such as a check valve to assure isolation of the booster system from the sanitary system mains. Such a system isolation check valve may be positioned in an extraction conduit before or after a water flow meter.

Water supply though the extraction conduit enters the pump chamber near the top for standard flow conditions, but this inlet is located near the bottom of the chamber in high volume or continuous run applications to improve pump motor cooling.

Pump motor operation is regulated by two sensor control units. One sensor monitors pump discharge line pressure to start the pump when that pressure falls below a preset threshold value and to disable the pump when the discharge line pressure exceeds a second preset value. The other sensor monitors pump chamber inlet pressure and disables the pump motor when the pump chamber pressure falls below a threshold pressure.

BRIEF DESCRIPTION OF THE DRAWINGS

Relative to the drawings wherein like reference characters designate like or similar elements throughout the several drawing figures.

DETAILED DESCRIPTION OF THE PREFERRED EMBODIMENT

Figure 1:
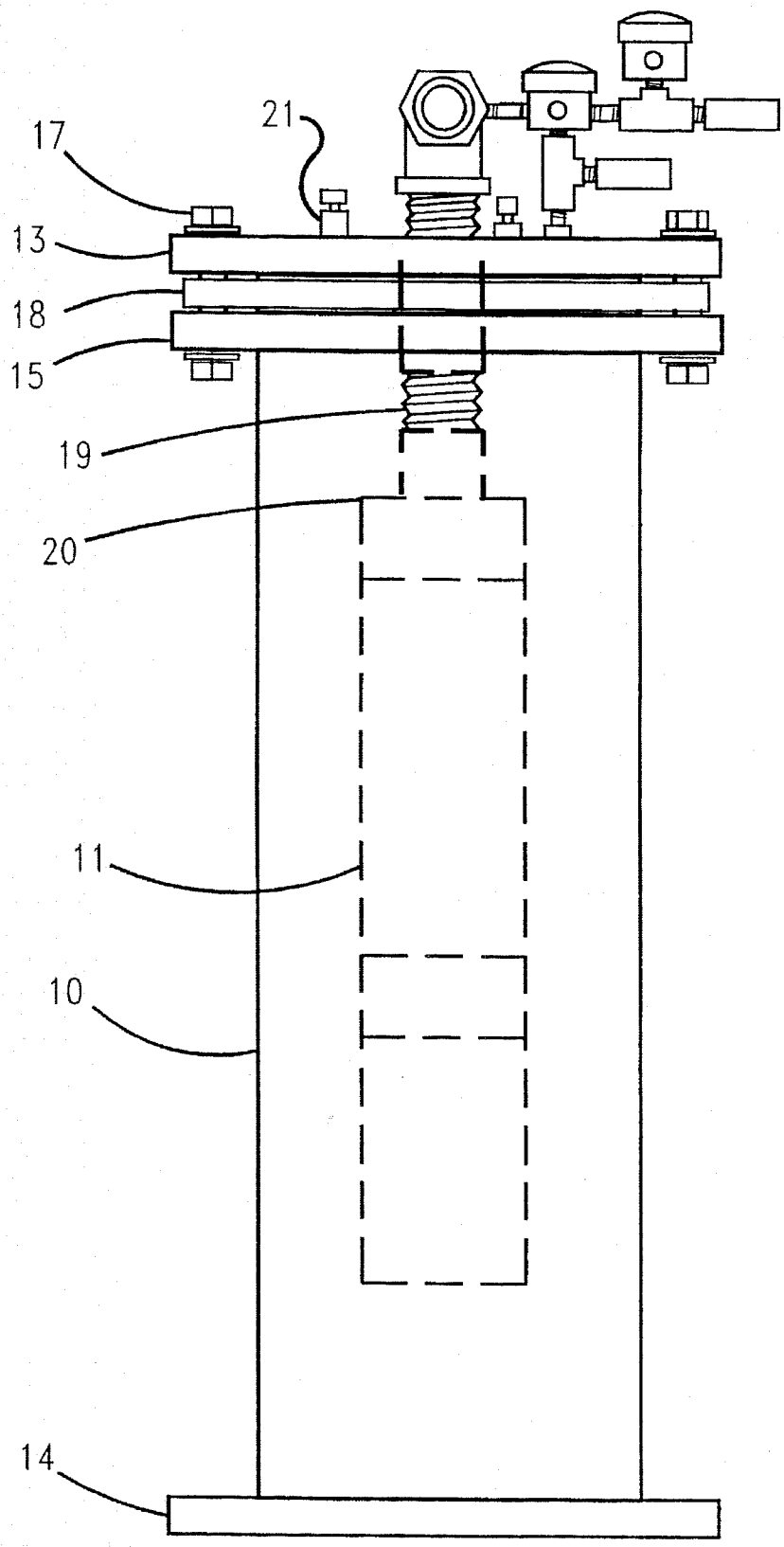
FIG. 1 is an elevational view of the invention oriented along the axial direction of input/output flow.
Figure 2:
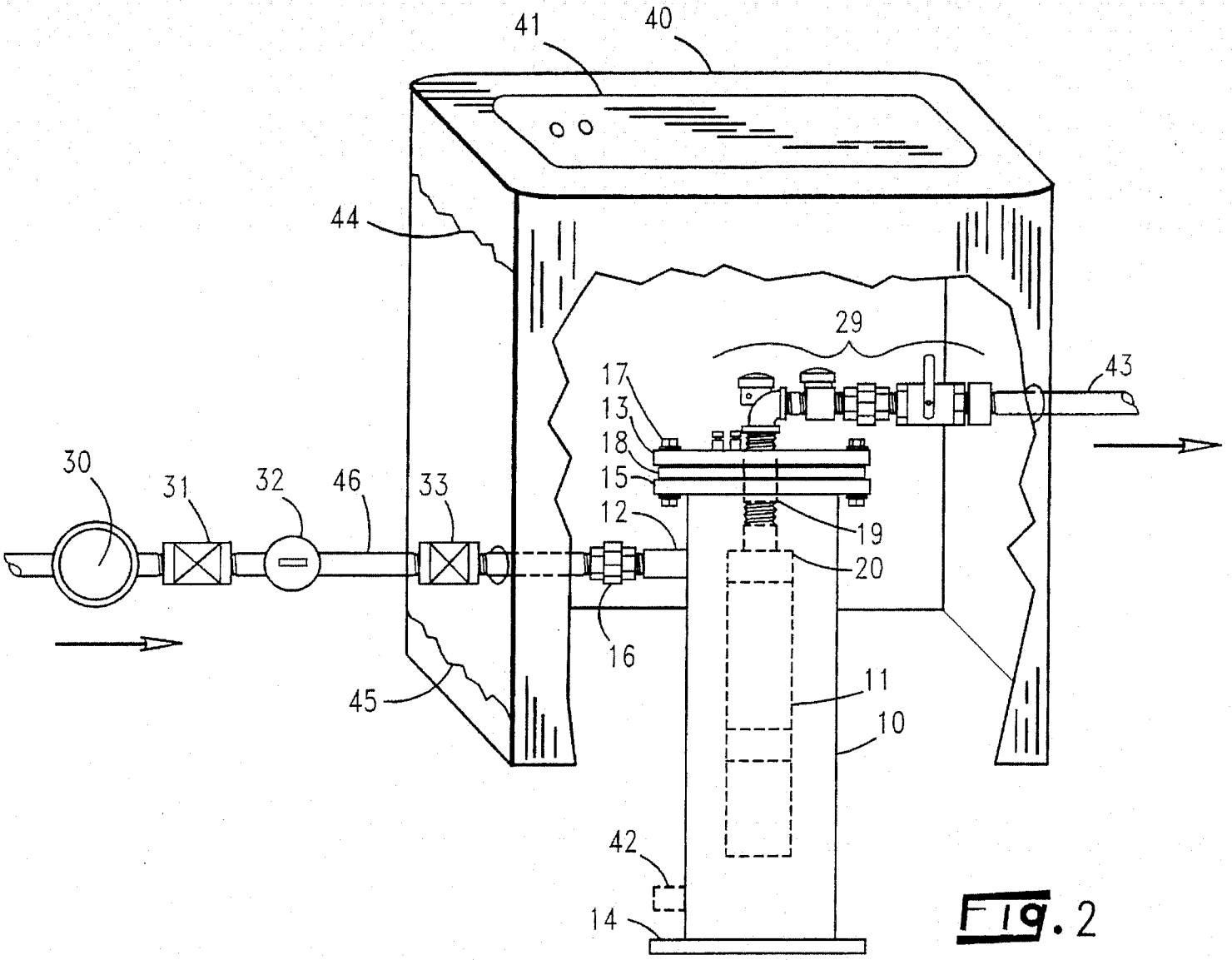
FIG. 2 is an elevational view of the invention rotated 90 degrees with reference to FIG. 1 and showing a typical plumbing arrangement.
Figure 5:
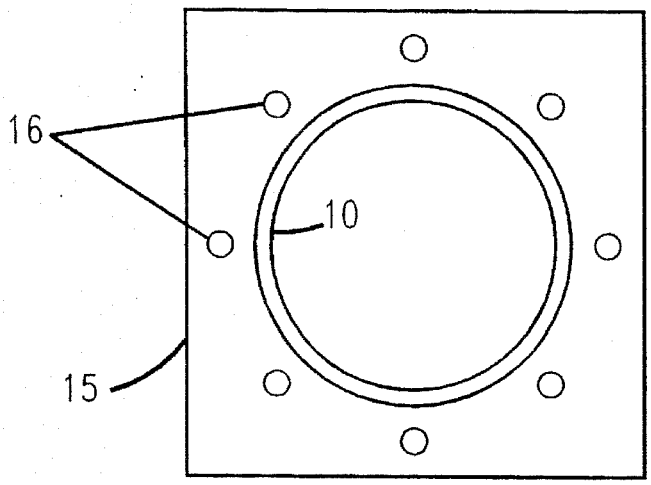
FIG. 5 is a top plan view of the ring flange.

In accordance with a preferred embodiment of the present invention as shown in FIGS. 1 and 2, a booster device includes an enclosed pump chamber 10, a submersible, axial flow, turbine water pump 11 within the pump chamber 10, a water supply conduit inlet 12 to the pump chamber 10, and a top cap flange 13 to which a water outlet manifold assembly 29 and submersible pump 11 are structurally attached. The enclosed pump chamber 10 is a cylindrical tube formed, for example, of steel or high density polymer material. The cylindrical tube is closed at both ends to form the pump chamber 10. The bottom end of the pump chamber is closed, for example, with either an anchor plate 14 or 2 blind end cap. The top of the pump chamber is closed by a removable cap flange 13. A ring flange 15 is permanently affixed to the top of the tube. As illustrated in FIG. 5, this ring flange contains apertures 16 to provide coaxial alignment with corresponding apertures in the cap flange 13.

It is contemplated that a variety of pump sizes may be used in conjunction with a single pump chamber size. The cylindrical tube of the pump chamber may be formed from an appropriate length and diameter of pipe as dictated by the size and performance requirements of the largest capacity pump to be used. For large capacity pumps, the tube diameter provides at least 0.50 inches of clearance between the pump and the tube walls, and the tube length is preferably at least 6.0 inches greater than the pump length.

As illustrated in FIG. 2, a water supply system comprises a municipal water treatment plant, not shown, for supplying potable water to the user via a supply conduit 30, an extraction flow meter 32 for measuring the quantity of water used, a ball valve 31 upstream of the meter to shut off water flow during maintenance, and a user-installed check valve 33 downstream of the flow meter 32 for flow directional rectification to prevent contamination of the municipal supply conduit by backflow through the meter. Water from the supply conduit 30 enters the pump chamber through the conduit 12 near the chamber top for standard flow conditions. An alternative inlet 42 is located near the bottom of the pump chamber in high volume or continuous run applications to improve pump motor cooling. The supply inlet is fitted, for example, with a brass compression water line fitting 16 for mating with the supply conduit. Diameter size of the brass fitting may vary to accommodate various sizes of supply conduit.

Referring to FIGS. 1, 2, 3 and 4, the cap flange 13 formed, for example, of steel material is constructed to mount to the ring flange 15 via a plurality of flange clamping bolts 17. In a preferred embodiment, eight flange bolts are specified. However, structural requirements for larger volume units may require more than eight flange bolts. A standard flange gasket 18 is inserted at the interface between the ring flange and the cap flange to provide a water-tight seal. The flange gasket is constructed to match the apertures in the ring flange shown in FIG. 5.

As shown in FIGS. 1 and 2, the cap flange 13 has, at its center, a male threaded pipe nipple 19, threaded on both ends, penetrating the center of the cap flange in coaxial alignment with the pump chamber axis. The size of the central cap flange nipple is selected to thread into the female threaded coupling of the pump discharge. The pump body 11 screws directly upon the threads of the central cap flange nipple to structurally unitize the pump, the cap flange, and the outlet manifold assembly. In a preferred embodiment, the pump is an axial flow, submersible, turbine pump.

Figure 3:
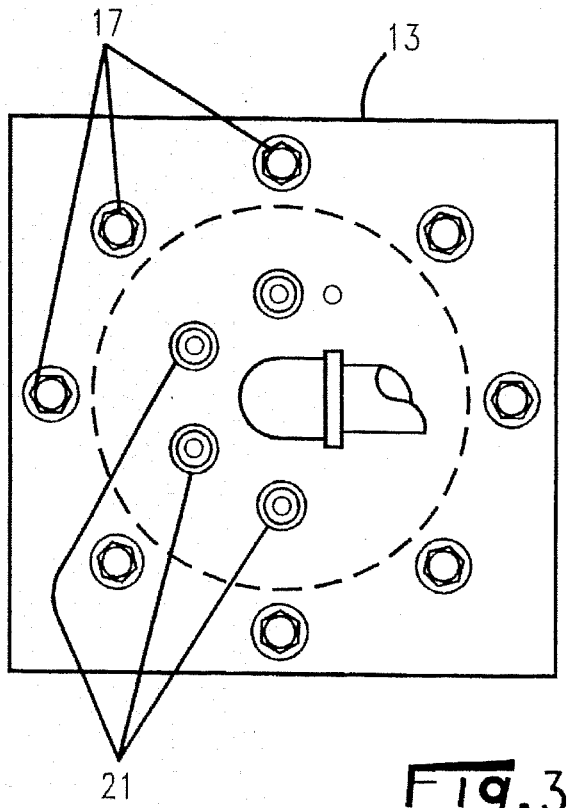
FIG. 3 is a top plan view of the invention as oriented in FIG. 2, excluding the outlet manifold assembly.
Figure 4:
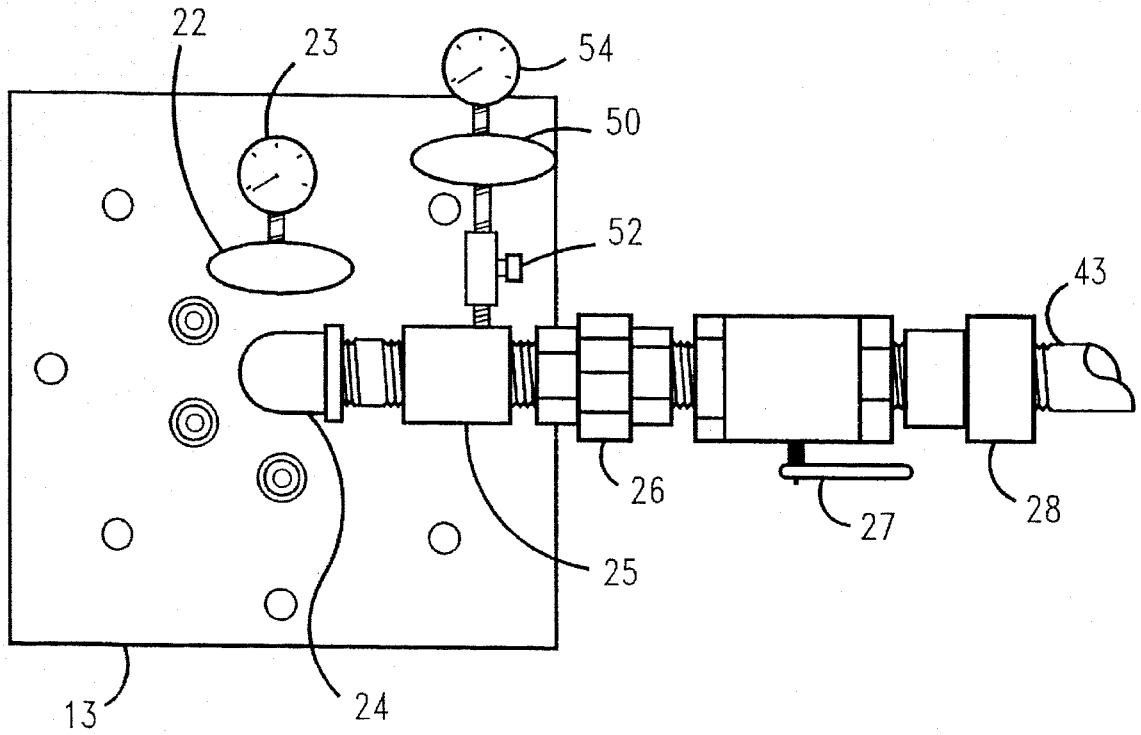
FIG. 4 is a top plan view of the invention showing detailed features of the cap flange and output manifold assembly.

In the cap flange annulus shown by FIG. 3 between the central nipple and the pipe wall are several couplings 21 attached to the outside face of the cap flange. These couplings are fitted internally with compression type fluid seals around electric power conductor wires serving the pump motor. The number of these couplings is dependent on the pump power type and wiring harness. In a preferred embodiment, four spaced couplings are used: three for respective carrier wires in a 240 V power source and one to connect a low pressure sensor 22, as illustrated in FIG. 4, which senses pump chamber pressure and interrupts power to the pump motor in the event of water supply failure. As shown in FIG. 4, the low pressure sensor is fitted with a standard pressure gauge 23 for visual determination of pump chamber pressure.

With continued reference to FIG. 4, a water outlet manifold assembly is attached to the cap flange. In a preferred embodiment, a 90° elbow joint 24 is attached to the portion of the central nipple 19 (FIG. 2) protruding outwardly from the cap flange. This elbow joint is installation-dependent and may, for example, be eliminated if the installation so requires. A male threaded nipple connects a check valve 25 to the elbow joint. The check valve prevents backflow through the pump outlet and into the pump chamber when the pump is not in operation. Connected to the check valve via a male threaded nipple is a standard union fitting 26 for coupling/decoupling of the cap flange to/from the outlet manifold assembly. Attached to the union fitting via a male threaded nipple is a ball valve 27 for shutting off backflow during maintenance. Attached to the ball valve via a male threaded nipple is a compression fitting 28 used for coupling to an outlet water conduit. It is contemplated that the size of these elements may vary in relation to the diameter of the pump discharge.

Connected to the modified check valve 25 is a pump control pressure switch 50 to regulate power to the pump motor for maintenance of the pump discharge pressure between upper and lower control limits, when the discharge pressure falls below a lower limit, the power switch closes to power the motor. When the discharge pressure exceeds an upper limit, the power switch for the motor opens. In a preferred embodiment, a male threaded nipple is used to connect a throttle/snubber valve 52 to the check valve 25. This throttle snubber valve is installed upstream of the sensor and pressure gauge to facilitate the latter's maintenance and to also act as a pulsation dampening device. Attached to the valve via a male threaded nipple is a standard T joint: one end of which is used to attach the pump control pressure switch 50; the other end being used to attach a standard pressure gauge 54.

In application, the vertical orientation of the present invention normally facilitates the original installation and subsequent servicing of a water pump for boosting flow from a large delivery system (municipal supply 30) that frequently includes an extraction flow meter 32. Water usage can be metered either upstream of the booster device as in single facility or residential applications, or it can be metered downstream of the booster device as in larger capacity units that may serve multiple customers or facilities. The present invention may be set, anchored and plumbed independent of the consumer delivery line.

It is contemplated that because the tube system of the present invention is narrow and vertical, it can be easily mounted in a typical water meter box 40 in a vertical orientation. The water meter box 40 is installed in the ground so that a portion of the top of the box is usually positioned at the approximate local grade level with the inside portion of the box being excavated of dirt so that the ground level outside the meter box 44 is retained at a higher level than the ground level inside the meter box 45. A prefabricated meter box 40 usually has no bottom structure. The top of chamber 10 is located at the desired vertical height and lateral position within the raw excavation and temporarily secured by partial backfilling. The meter box is then positioned over the exposed upper end of the chamber 10 at the desired grade level for backfill completion. With the meter box cover 41 removed, the pump 11, with the cap flange 13 attached, can be lowered in stable, vertical plumb alignment, either manually or by portable lift equipment, through the port for installation within the chamber 10. The fluid supply conduit 46 is connected to the chamber inlet 12. By aligning the pump chamber 10 with the meter box top port, maintenance can be easily performed through the port. With all external plumbing and wiring in place and the pump attached to the cap flange 13 and inserted into the vessel chamber, the cap flange sealed and secured. Finally, the outlet conduit 43 and pump motor wiring are connected.

Figure 6:
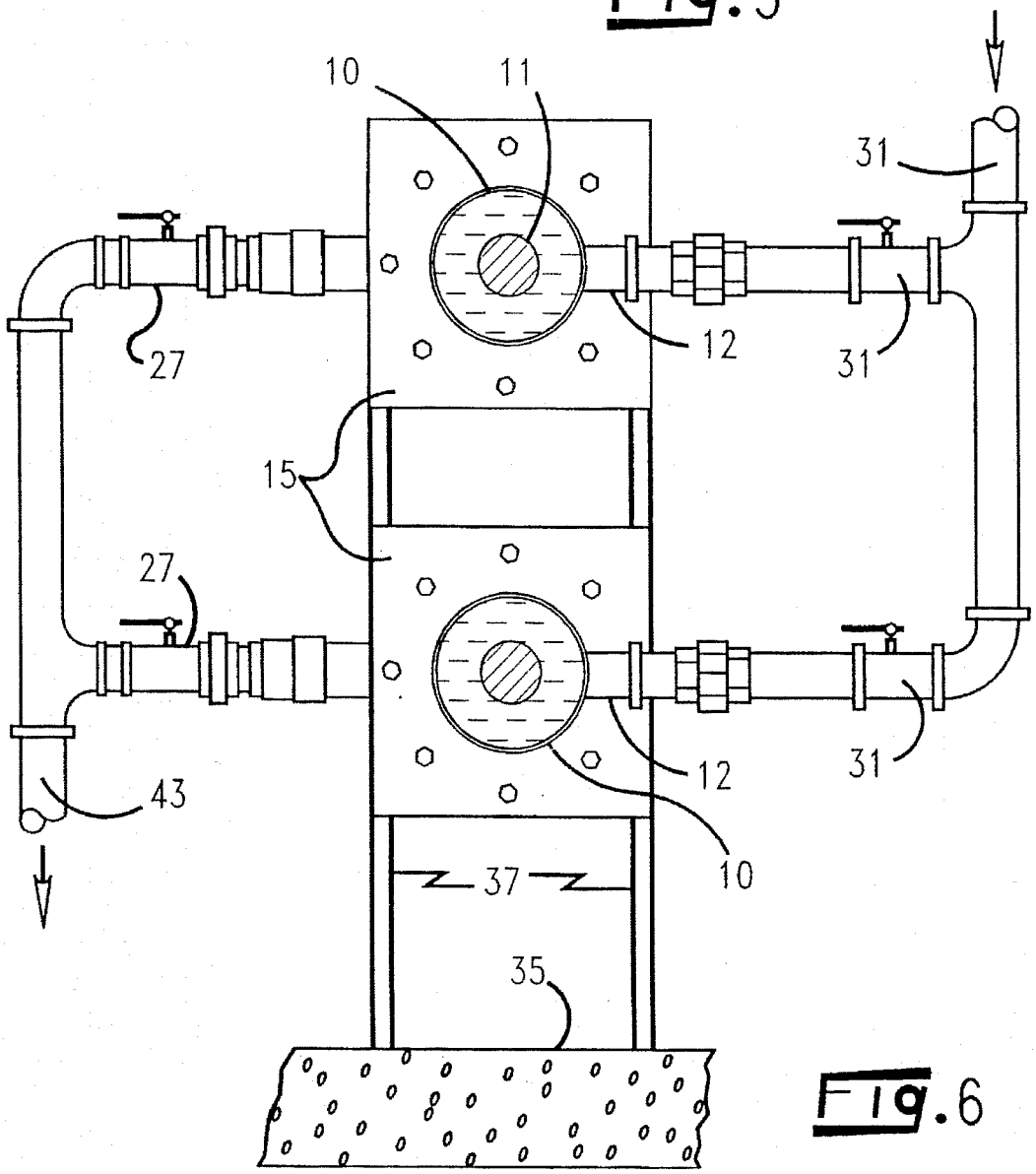
FIG. 6 is a sectioned elevation of a horizontally disposed embodiment of the invention.

Although the vertical meter box installation orientation of FIGS. 1 and 2 will normally be the preferred embodiment of the invention, occasions and circumstances may arise to dictate a preferably horizontal orientation. Horizontal alignment may be more suitable for location of the equipment inside a building or other above ground enclosure. Additionally, in larger capacity systems, the physical length of the pump chamber may be too long to assemble and mount in a vertical position. Accordingly, FIG. 6 illustrates a horizontal embodiment of the invention wherein two horizontal parallel pump chambers 10 mounted on a fabricated frame 37 above a floor plane 35 are connected in duplex with the suction 31 and discharge 43 piping plumbed together to common inlet and discharge pipes, respectively. In some respects, this embodiment of the invention offers more convenient and effective maintenance access. For example, such an installation may be more appropriate for an internal basement housing above a basement floor grade where there is inadequate ceiling clearance to axially align the pumps 11 with the chamber tubes 10 in extension therefrom preparatory to telescope insertion but sufficient horizontal floor area is available.

In other respects, the general layout of the invention remains the same in the horizontal position as in vertical alignment in that the chamber inlet coupling 12 may be in the side of the chamber 10 wall or the chamber end. In either case, the pump 11 discharge threads directly to the discharge pipe and the top cap flange 13 contains the discharge nipple 19 and the motor conduit compression seal couplings 21. The same pressure monitoring switches are used to measure the lower pump chamber pressure and the greater, pump discharge pressure.

Thus, it will be appreciated that as a result of the present invention, a highly effective, improved booster devise is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention can be determined by reference to the appended claims.

We claim:

1. A hydraulic pressure booster device for increasing in-line fluid pressures, comprising:

a submersible fluid pump driven by a submersible electric motor, said pump and motor being structurally combined as an integrated pumping unit, fluid containment means for pressurized immersion of said integrated pumping unit, fluid supply means for substantially completely filling said containment means with pumped fluid at a first pressure greater than atmospheric pressure, fluid outlet means for discharging said pumped fluid from said submersible pump at a second pressure greater than said first pressure, motor protection means for monitoring the presence of the pumped fluid pressure within said containment means and disabling said submersible electric motor when a low threshold fluid pressure level is sensed, and, motor control means responsive to said second pressure to operate said pump and motor when said second pressure is below a first threshold and to disable said pump and motor when said second pressure rises above a second threshold greater than said first threshold.

2. A booster device as described in claim 1, wherein said fluid supply means delivers said pumped fluid into said containment means at a position relative to said pump whereby said pumped fluid must flow over said submersible motor.

3. A booster device as described in claim 1 wherein said fluid containment means is confined within a ground retaining housing having a removable top covering.

4. A booster device as described by claim 1 wherein said fluid supply means comprises fluid flow metering means.

5. A booster device as described by claim 1 wherein said fluid supply means comprises flow rectification means to assure flow isolation of said containment means from a pumped fluid supply source.

6. A booster device as described in claim 1, wherein said fluid containment means comprises a tubular pump chamber with enclosure means.

7. A booster device as described in claim 6, wherein said pump chamber is made of steel.

8. A booster device as described in claim 6, wherein said pump chamber is made of a high density polymer material.

9. A booster device as described in claim 6, wherein said tubular pump chamber is vertically oriented.

10. A booster device as described in claim 9, wherein said enclosure means comprises a top enclosure for the top of said tubular pump chamber and a bottom enclosure for the bottom of said tubular pump chamber.

11. A booster device as described in claim 10, wherein said bottom enclosure comprises an anchor plate.

12. A booster device as described in claim 10, wherein said bottom enclosure comprises a blind end cap.

13. A booster device as described in claim 10, wherein said top enclosure comprises a ring flange affixed to the top of said pump chamber, a cap flange attached to said ring flange, and a gasket between said ring flange and said cap flange forming a watertight seal between them.

14. A booster device as described in claim 13, wherein a male threaded pipe nipple, threaded on both ends, is attached to the center of said cap flange and oriented in coaxial alignment with the axis of said pump chamber, the threaded ends protruding perpendicularly from either side of the cap flange, the lower end protruding downward into the pump chamber and the upper end protruding upward away from the pump chamber.

15. A booster device as described in claim 14, wherein said pump is connected to the lower end of said male threaded pipe nipple, the upper end of said pipe nipple connected to said outlet means.

16. A booster device as described in claim 14, wherein said outlet means comprises a 90 degree elbow joint connected to the upper end of said pipe nipple, a check valve connected to said elbow joint, a union fitting connected to said check valve, a ball valve connected to union fitting, and a compression coupling connected to said ball valve at one end and attached to a fluid outlet conduit at the other end.

17. A booster device as described in claim 16, wherein said fluid supply means comprises a compression coupling attached at one end to an inlet opening in said pump chamber, the other end attached to a fluid inlet conduit.

18. A booster device as described in claim 17, wherein said inlet opening is located near the top of said pump chamber.

19. A booster device as described in claim 17, wherein said motor protection means comprises an input fluid pressure sensor which senses fluid pressure within said tubular chamber and interrupts pump motor power at a low pressure threshold, and an output fluid pressure sensor which senses fluid pressure within said fluid outlet means and interrupts pump motor power at a low pressure threshold or a high pressure threshold.

20. A cap flange for closing a pump isolation chamber, comprising:

substrate means for arranging and mounting pump control and functional components, coupling means for providing watertight penetration of components through said substrate means into said pump isolation chamber, first sensor means for sensing fluid pressures within said pump isolation chamber and disabling a fluid pump motor within said pump isolation chamber when fluid pressure within said pump isolation chamber falls below a first threshold pressure that is greater than atmospheric pressure, fastener means for structurally attaching said substrate means to said pump isolation chamber, outlet means for routing pressurized fluid from a pump driven by said motor within said pump isolation chamber through said substrate means into a fluid conduit, second sensor means for sensing fluid pressures within said outlet means to operate said fluid pump when outlet fluid pressure is below a second threshold pressure and to disable said pump when outlet fluid pressure rises above a third threshold pressure, and attachment means for unitizing said pump with said outlet means.

21. A cap flange as described in claim 20, wherein said substrate means is made of steel.

22. A cap flange as described in claim 20, wherein said fastener means comprises a plurality of bolts, said bolts penetrating through apertures near the perimeter of said cap flange in coaxial alignment with apertures in a ring flange affixed to said pump chamber.

23. A cap flange as described in claim 22, wherein said coupling means comprises a plurality of compression type fluid seals penetrated by electrical components and said first sensor means.

24. A cap flange as described in claim 23, wherein said first sensor means comprises a fluid pressure sensor, monitoring means for comparing sensed pressures within said isolation chamber to a selected first threshold pressure and for disabling said fluid pump motor when said sensed pressure is below said first threshold pressure.

25. A cap flange as described in claim 24, wherein said second sensor means comprises a fluid pressure sensor, second monitoring means for comparing sensed pressures with a range of operating pressures and disabling said fluid pump motor when sensed pressure is either above or below said pressure range.

26. A cap flange as described in claim 25, wherein said attachment means is a male threaded pipe nipple, threaded on both ends, attached to the center of said cap flange with the threaded ends protruding from either side of the cap flange perpendicularly, the upper end protruding upward and away from said pump chamber.

27. A cap flange as described in claim 26, wherein said outlet means comprises a 90 degree elbow joint connected to the upper end of said pipe nipple, a check valve connected to said elbow joint, a union fitting connected to said check valve, a ball valve connected to said union fitting, and a compression coupling connected to said ball valve at one end and attached to a fluid outlet conduit at the other end.

28. A potable water supply system for distributing potable water from a source distribution conduit, said system comprising:

closed chamber means for enclosing an axial flow submersible pump, said chamber means having a selectively removable first end closure that is penetrated by a pump discharge conduit, said end closure being structurally unified with said pump by said discharge conduit;

extraction conduit means for carrying a transfer flow of water from a source distribution conduit into said chamber means;

flow rectification means in said extraction conduit means to isolate water entering said chamber means from returning to said source distribution conduit; and pressure responsive switch means for monitoring water pressure in said chamber means relative to a set-point pressure and de-energizing said pump when chamber means water pressure falls below said set-point pressure.

29. A potable water supply system as described by claim 28 wherein said chamber means includes an axially elongated tube closed at the top end thereof by said end closure, said chamber means axis being substantially vertically oriented with said top end being positionally set below a local ground surface level within a ground retaining enclosure having a selectively covered top opening, said ground retaining enclosure having a top surface set at about said local ground surface level.

30. A potable water supply system as described by claim 29 wherein said extraction conduit means includes a flow measuring means between said source distribution conduit and said chamber means.

* * * * *